United States Patent [19]

Nicolaisen

[11] 4,380,000

[45] Apr. 12, 1983

[54] COIL ARRANGEMENT, PARTICULARLY FOR RELAYS, AND METHOD OF MAKING SAME

[75] Inventor: Holger Nicolaisen, Nordborg, Denmark

[73] Assignee: Danfoss A/S, Nordborg, Denmark

[21] Appl. No.: 318,833

[22] Filed: Nov. 6, 1981

[30] Foreign Application Priority Data

Nov. 15, 1980 [DE] Fed. Rep. of Germany ..... 3043148

[51] Int. Cl.[3] ..... H01F 15/10

[52] U.S. Cl. ..... 336/192; 29/602 R

[58] Field of Search ..... 29/602 R, 605; 336/192, 336/198, 208; 310/71; 338/322, 324

[56] References Cited

U.S. PATENT DOCUMENTS 4,135,297 1/1979 Guttenberger et al. ..... 336/192 X

FOREIGN PATENT DOCUMENTS 1213910 4/1966 Fed. Rep. of Germany ..... 336/192

*Primary Examiner*—Thomas J. Kozma

*Attorney, Agent, or Firm*—Wayne B. Easton

[57] ABSTRACT

The invention relates to a coil assembly and a method for making same. In particular the invention is directed to the attachment of a terminal pin to the coil assembly base plate and the connecting of the terminal pin to an end portion of the coil wire in a manner which lessens the chances of inadvertently breaking the coil wire.

2 Claims, 1 Drawing Figure

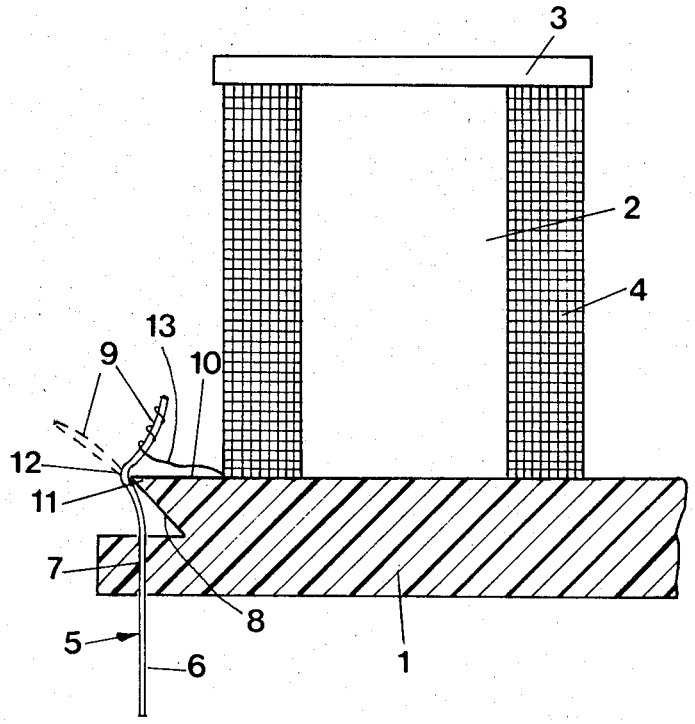
3
2
4
13
9
10
12
11
7
8
5
6
1

COIL ARRANGEMENT, PARTICULARLY FOR RELAYS, AND METHOD OF MAKING SAME

The invention relates to a coil arrangement, particularly for relays, comprising a base plate on which there is mounted an upright coil and through which there passes at least one terminal pin which, on the side of the base plate opposite to the coil, extends substantially parallel to the coil axis and contains a bend to secure against axial loads, and to a method of making this coil arrangement.

In a known coil arrangement of this kind (DE-OS No. 26 12 582), the terminal pin is moulded in during injection of the base plate from plastics material. The terminal pin is in this case located in the parting plane of the injection mould. Portion of the terminal pin disposed within the base plate is, during closing of the mould, bent out of the pin axis by a punch provided on the one mould part. The base plate is moulded in one piece with a winding tube on which the coil is wound. The end of the terminal pin facing the coil impedes this, for which reason this end must be bent aside before winding. After winding of the coil, the end can be bent back again.

In this construction, the terminal pins are secured against axial loads but at the expense of the pin preventing winding of the coil unless the end of the pin facing the coil is severely deformed twice at the same position, which could easily cause the pin to break.

In contrast, there are coil arrangements in which the terminal pins are pushed through preformed insert holes. In this case, since the pins do not have to be applied during moulding of the base plate, pressing in can take place at any desired later stage and there is no fear of obstructing application of the coil. However, such terminal pins can become loose upon axial loading.

The invention is based on the problem of providing a coil arrangement of the aforementioned kind in which the terminal pin or pins secured against axial loading do not already have to be introduced in the base plate during injection moulding thereof.

This problem is solved according to the invention in that the base plate contains an insert hole of which the end facing the coil is covered by an oblique face which terminates in an outwardly directed bending edge, and that the terminal is bent about the bending edge.

In this construction, pressing the terminal pin into the preformed insert hole causes the leading end of the pin to be bent outwardly under the influence of the oblique surface which also results in additional gripping in the insert hole. By bending the leading end about the edge, the terminal pin is then securely locked. The only operation additional to pressing in is the readily realisable step of bending over.

With particular advantage, the bending edge is formed between the oblique face and the surface of the base plate facing the coil. This simplifies moulding of the base plate. The base plate surface facing the coil may be continuous up to the bending edge.

A method of making the coil arrangement is characterised according to the invention in that the terminal pin is pushed through the insert hole until its leading end projects laterally beyond the bending edge under the influence of the oblique face, that in this position the coil wire is soldered to the leading end, and that the leading end is then bent about the bending edge.

This procedure first utilises the fact that the laterally projecting ends of the terminal pins are readily accessible to the soldering tool and, in particular, permit soldering by machine if the end of the coil wire was previously wound around the terminal pin. In this method the terminal pin is securely held because it is clamped in the insert hole by the oblique face. During subsequent bending about the bending edge, the distance between the point of soldering and the coil is shortened, so that the soldered on coil wire cannot be under tension.

The invention will now be described in more detail with reference to a preferred example shown in the drawing which is a diagrammatic section through a coil arrangement according to the invention.

The coil arrangement comprises a base plate 1 made in one piece with a winding tube 2 and end flange 3. The winding tube has a coil 4 wound on it. The arrangement may serve as part of a relay, particularly a micro-relay in which the winding tube is traversed by a core connected to a yoke adjacent to the coil, an armature which is connected to the yoke covering the upper end.

Both coil connections are provided by a respective terminal pin 5 of which the lower end 6 is parallel to the coil axis. The terminal pin is passed through an insert hole 7 of the base plate 1 that is covered by an outwardly directed oblique face 8. Consequently, the leading end 9 of the terminal pin 5 is deformed while pressing into the insert hole 7 as shown in broken lines. The end of the oblique face 8 together with the surface 10 of the base plate 1 form a bending edge 11, about which the leading end 9 of the terminal pin 5 is subsequently bent so that one obtains the position shown in full lines. As a result, the terminal pin 12 possesses a kink 12 with which it is locked to the bending edge 11. In addition, it is clamped in the insert hole 7 by reason of abutting the oblique face 8. This provides a high safeguard against the terminal pin 5 slipping when an axial load occurs.

When the leading end 9 has the broken line position, it projects laterally beyond the bending edge 11 and even beyond the base plate 1. In this position, the coil wire is wound around the end 9 and soldered by machine. After bending about the bending edge 11, the coil wire 13 is loose. Should the end 9 become slightly bent under the influence of transverse stressing, this will not cause a load to be applied to the coil wire 13.

By means of such an arrangement, the lower ends of the terminal pins 6 can be so accurately aligned that the coil arrangement may also be used in conjunction with printed circuits, into the holes of which the ends 6 can be inserted and then soldered.

I claim:

1. A coil assembly for a relay or the like, comprising, a base plate having first and second sides, a cylindrically shaped coil mounted on said first side of said base plate in normal relations thereto, said coil having a coil wire end portion, said base plate having a notch radially displaced from said coil forming with said base plate second side a protruding portion and having an obliquely extending face which intersects said base plate first side to form a lip portion, a normally extending hole in said protruding portion having a locus which intersects said obliquely extending face, a terminal pin in said hole and bent around said lip portion in the direction of said coil, and said coil wire end portion being connected to said terminal pin.

2. A method of making a coil assembly comprising the steps of providing a base plate having first and second sides, forming a notch in said base plate in relation to said second side thereof to form a protruding portion, forming an obliquely extending face on said notch in relation to said base plate first side to from a lip portion, mounting a cylindrically shaped coil on said base plate first side in spaced relation to said lip portion, providing a hole in said base plate protruding portion having a locus which intersects said obliquely extending face, inserting a terminal pin in said hole and extending said pin beyond said lip portion in a direction away from said coil, connecting a coil wire end portion to said terminal pin, and bending said terminal pin around said lip portion towards said coil to provide slack in said coil wire end portion.

* * * * *